US006878217B2

(12) United States Patent
Kikugawa et al.

(10) Patent No.: US 6,878,217 B2
(45) Date of Patent: Apr. 12, 2005

(54) RARE EARTH METAL-BASED PERMANENT MAGNET HAVING CORROSION-RESISTANT FILM AND METHOD FOR PRODUCING THE SAME

(75) Inventors: Atsushi Kikugawa, Osaka (JP); Fumiaki Kikui, Osaka (JP)

(73) Assignee: Neomax Co. Ltd., Osaka (JP)

( * ) Notice: Subject to any disclaimer, the term of this patent is extended or adjusted under 35 U.S.C. 154(b) by 0 days.

(21) Appl. No.: 10/265,725

(22) Filed: Oct. 8, 2002

(65) Prior Publication Data

US 2003/0136471 A1 Jul. 24, 2003

Related U.S. Application Data

(62) Division of application No. 09/924,476, filed on Aug. 9, 2001.

(30) Foreign Application Priority Data

Aug. 11, 2000 (JP) ..... 2000-245410
Oct. 16, 2000 (JP) ..... 2000-315776

(51) Int. Cl.[7] ..... H01F 1/053

(52) U.S. Cl. ..... 148/101; 148/261; 148/243; 148/273; 148/284; 423/405; 428/457; 428/611; 428/701; 428/702; 428/900

(58) Field of Search ..... 148/101, 261, 148/243, 273, 284; 427/405; 428/457, 611, 701, 702, 900

(56) References Cited

FOREIGN PATENT DOCUMENTS

CN 1259754 A 7/2000
EP 1 011 112 A2 6/2000
JP 2000150216 A * 5/2000 ..... H01F/1/08

OTHER PUBLICATIONS

Patent Abstracts of Japan, vol: 2000, No. 10, 17, Nov. 2000 and JP 2000 199074, Jul. 18, 2000.

Chinese Office Action dated Apr. 9, 2004 with full English translation of office action.

* cited by examiner

*Primary Examiner*—John P Sheehan
(74) *Attorney, Agent, or Firm*—Armstrong, Kratz, Quintos, Hanson & Brooks, LLP

(57) ABSTRACT

The chemical conversion film containing, at least as the constituent components thereof, (a) at least one of the metals selected from molybdenum, zirconium, vanadium, and tungsten; (b) a rare earth metal constituting the magnet; and (c) oxygen, which is formed on the surface of a rare earth metal-based permanent magnet according to the present invention, contains a composite metal oxide provided on the surface of the R-rich phase having a lower oxidation-reduction potential through a preferential reaction of the metallic ions that are present in the form of complex ions or oxide ions, such as of molybdenum, contained in the treatment solution, with the rare earth metals that elute from the magnet. Thus formed composite metal oxide reduces the difference in corrosion potential as to realize a uniform surface potential, and effectively suppresses the corrosion based on potential difference. Furthermore, the chemical conversion film thus formed exhibits excellent corrosion resistance even if it is provided as a thin film. The production method thereof can be implemented at low cost and by a simple process comprising treating the surface of the magnet by using a treatment solution containing a molybdate and the like.

5 Claims, No Drawings

RARE EARTH METAL-BASED PERMANENT MAGNET HAVING CORROSION-RESISTANT FILM AND METHOD FOR PRODUCING THE SAME

This application is a divisional of prior application Ser. No. 09/924,476 filed Aug. 9, 2001.

BACKGROUND OF THE INVENTION

1. Field of the Invention

The present invention relates to a rare earth metal-based permanent magnet having a corrosion-resistant film, and to a method for producing the same.

2. Description of the Related Art

Rare earth metal-based permanent magnets, for instance, R—Fe—B based permanent magnets wherein R is a rare earth metal, represented by a Nd—Fe—B based permanent magnet, or R—Fe—N based permanent magnets represented by a Sm—Fe—N based permanent magnet, etc., and particularly R—Fe—B based permanent magnets, are employed today in various fields because they utilize inexpensive materials abundant in resources, and possess superior magnetic properties.

However, since a rare earth metal-based permanent magnet contains a highly reactive rare earth metal, i.e., R, they are apt to be oxidized and corroded in the atmosphere, and in case they are used without applying any surface treatment, corrosion tends to proceed from the surface in the presence of small water as well as acidic or alkaline substances to generate rust. This leads to the degradation and the fluctuation in magnetic properties. Moreover, in case such a rusty magnet is embedded in a magnetic circuit and a like device, there is fear of scattering rust as to contaminate peripheral components.

In the light of the aforementioned circumstances, there is proposed a method of forming a corrosion-resistant film on the surface of the rare earth metal-based permanent magnet, and as a method for forming the corrosion-resistant film on the surface, there is proposed a method of forming a resin film by means of the application of resin, a method of forming a metal-plated film by means of wet plating, vapor phase plating, etc., or a method of forming a chemical conversion film such as a phosphate film or a chromate film, which are put into practice.

However, since there is formed a mixed phase consisting of a $Nd_2Fe_{14}B$ phase having a noble oxidation-reduction potential as the principal phase and a Nd-rich phase having an oxidation-reduction potential lower than that of the principal phase as the grain boundary phase in the vicinity of the surface of a rare earth metal-based permanent magnet, for instance, a Nd—Fe—B based permanent magnet, it is known that electrochemical corrosion occurs based on potential difference depending on the potential differing from phase to phase.

If a corrosion-resistant film as described above is formed on the surface of the magnet, the corrosion based on potential difference can be suppressed as a result. However, the films above do not suppress the corrosion itself based on the difference in corrosion potential, but they are based on the concept of, so to say, sealing the corrosion depending on the corrosion potential by coating the entire surface of the magnet with a uniform film. Accordingly, since a film from several to several tens of micrometer in thickness is necessary to seal the corrosion depending on potential difference, a limit is automatically set in implementing a film with a high dimensional precision (i.e., in realizing a film as thin as possible, or in imparting high corrosion resistance while reducing thickness of the thin film). Furthermore, since complicated process steps are generally necessary in forming a resin film or a metal-plated film, these processes are not always advantageous in view of process cost. In case of forming a chromate film, moreover, it requires use of an ecologically unfavorable hexavalent chromium, which leads not only to a complicated waste treatment, but also to a fear of causing influence upon the human body on handling the magnet containing hexavalent chromium in a trace quantity.

SUMMARY OF THE INVENTION

In the light of the circumstances above, an object of the present invention is to provide a rare earth metal-based permanent magnet having formed on the surface thereof a film which effectively suppresses the corrosion due to potential difference, said film being a thin film with excellent corrosion resistance and ecologically favorable, yet producible at a low cost and by a simple process. Another object of the present invention is to provide a production method for the same.

The present inventors have extensively studied based on the aforementioned problems, and, as a result, they have found that, on treating the surface of a rare earth metal-based magnet with a treatment solution containing a molybdate and the like, a composite metal oxide is formed on the surface of the R-rich phase having a lower oxidation-reduction potential through a preferential reaction of the metallic ions that are present in the form of complex ions or oxide ions, such as of molybdenum, with the rare earth metals that elute from the magnet. Thus formed composite metal oxide reduces the difference in corrosion potential as to realize a uniform surface potential, and effectively suppresses the corrosion based on potential difference. Furthermore, it has been found that the chemical conversion film thus formed exhibits excellent corrosion resistance even if it is provided as a thin film.

The present invention has been accomplished base on these findings. Thus, in accordance with a first aspect of the present invention, there is provided a permanent magnet comprising a rare earth metal-based permanent magnet having provided on the surface thereof a chemical conversion film containing, at least as the constituent components thereof, (a) at least one of the metals selected from molybdenum, zirconium, vanadium, and tungsten; (b) a rare earth metal constituting the magnet; and (c) oxygen.

According to a second aspect of the present invention, there is provided a permanent magnet as claimed in the first aspect, wherein the film further contains phosphorus.

According to a third aspect of the present invention, there is provided a permanent magnet as claimed in the first aspect, wherein the film further contains iron.

According to a fourth aspect of the present invention, there is provided a permanent magnet as claimed in the first aspect, wherein the film is provided at a film thickness of from 0.001 μm to 1 μm.

According to a fifth aspect of the present invention, there is provided a permanent magnet as claimed in the first aspect, wherein the rare earth metal-based permanent magnet is a R—Fe—B based permanent magnet.

According to a sixth aspect of the present invention, there is provided a permanent magnet as claimed in the fifth aspect, wherein the R—Fe—B based permanent magnet is a Nd—Fe—B based permanent magnet.

The present invention further provides, as described in the seventh aspect of the present invention, a method for producing a permanent magnet comprising a rare earth metal-based permanent magnet having provided on the surface thereof a chemical conversion film containing, at least as the constituent components thereof, (a) at least one of the metals selected from molybdenum, zirconium, vanadium, and tungsten; (b) a rare earth metal constituting the magnet; and (c) oxygen; the method comprising treating the surface of a rare earth metal-based permanent magnet with a treatment solution containing at least one selected from the group consisting of a molybdic acid or a salt thereof, a molybdenum oxide, a molybdophosphoric acid or a salt thereof, a zirconic acid or a salt thereof, a zirconium oxide, a vanadic acid or a salt thereof, a vanadium oxide, a tungstic acid or a salt thereof, and a tungsten oxide.

According to an eighth aspect of the present invention, there is provided a production method as claimed in the seventh aspect, wherein the treatment solution further contains an inorganic acid or a salt thereof.

According to a ninth aspect of the present invention, there is provided a production method as claimed in the eighth aspect, wherein the inorganic acid or the salt thereof is phosphoric acid or a salt thereof and/or a phosphorous acid or a salt thereof.

According to a tenth aspect of the present invention, there is provided a production method as claimed the seventh aspect, wherein the treatment solution further contains a divalent ion of magnesium.

According to an eleventh aspect of the present invention, there is provided a production method as claimed in the seventh aspect, wherein the treatment solution further contains a trivalent ion of iron.

According to a twelfth aspect of the present invention, there is provided a production method as claimed in the seventh aspect, wherein the treatment solution further contains an oxidizing agent.

According to a thirteenth aspect of the present invention, there is provided a production method as claimed in the twelfth aspect, wherein the oxidizing agent is nitric acid or a salt thereof and/or a nitrous acid or a salt thereof.

The chemical conversion film containing, at least as the constituent components thereof, (a) at least one of the metals selected from molybdenum, zirconium, vanadium, and tungsten; (b) a rare earth metal constituting the magnet; and (c) oxygen, which is formed on the surface of a rare earth metal-based permanent magnet according to the present invention, contains a composite metal oxide provided on the surface of the R-rich phase having a lower oxidation-reduction potential through a preferential reaction of the metallic ions that are present in the form of complex ions or oxide ions, such as of molybdenum, contained in the treatment solution, with the rare earth metals that elute from the magnet. Thus formed composite metal oxide reduces the difference in corrosion potential as to realize a uniform surface potential, and effectively suppresses the corrosion based on potential difference. Furthermore, the chemical conversion film thus formed exhibits excellent corrosion resistance even if it is provided as a thin film. The production method thereof can be implemented at low cost and by a simple process comprising treating the surface of the magnet by using a treatment solution containing a molybdate and the like.

DETAILED DESCRIPTION OF THE INVENTION

The permanent magnet according to the present invention is characterized by a rare earth metal-based permanent magnet having provided on the surface thereof a chemical conversion film containing, at least as the constituent components thereof, (a) at least one of the metals selected from molybdenum, zirconium, vanadium, and tungsten; (b) a rare earth metal constituting the magnet; and (c) oxygen.

In Japanese Patent Laid-Open No. 2000-199074 is disclosed a method of forming a deposition layer on the surface of a rare earth metal-based permanent magnet by depositing a compound containing a metallic element such as molybdenum, zirconium, vanadium, tungsten, etc. However, as is described in the paragraph number 0015 of the reference above, the deposition layer thus formed is not a chemical conversion film; i.e., the film does not contain any rare earth metals eluted from the magnet that is used as the mother material as the constituent component. Hence, the deposition layer disclosed therein differs from the chemical conversion film according to the present invention.

The permanent magnet according to the present invention is produced, for instance, by treating the surface of a rare earth metal-based permanent magnet with a treatment solution containing at least one selected from the group consisting of a molybdic acid or a salt thereof, a molybdenum oxide, a molybdophosphoric acid or a salt thereof, a zirconic acid or a salt thereof, a zirconium oxide, a vanadic acid or a salt thereof, a vanadium oxide, a tungstic acid or a salt thereof, and a tungsten oxide.

The treatment solution is prepared by dissolving into water, at least one selected from the group consisting of a molybdic acid or a salt thereof, a molybdenum oxide, a molybdophosphoric acid or a salt thereof, a zirconic acid or a salt thereof, a zirconium oxide, a vanadic acid or a salt thereof, a vanadium oxide, a tungstic acid or a salt thereof, and a tungsten oxide.

As a molybdate to be blended into the treatment solution, there can be mentioned lithium molybdate, sodium molybdate, potassium molybdate, magnesium molybdate, calcium molybdate, ammonium molybdate, etc.

The molybdenum oxide to be blended into the treatment solution is a compound expressed by a general formula $MoO_x$ (where x is in a range of from 2 to 3).

As a molybdophosphate to be blended into the treatment solution, there can be mentioned lithium molybdophosphate, sodium molybdophosphate, potassium molybdophosphate, magnesium molybdophosphate, calcium molybdophosphate, ammonium molybdophosphate, etc.

As a zirconate to be blended into the treatment solution, there can be mentioned lithium zirconate, sodium zirconate, potassium zirconate, magnesium zirconate, calcium zirconate, ammonium zirconate, etc.

The zirconium oxide to be blended into the treatment solution is a compound expressed by a general formula $ZrO_x$ (where x is in a range of from 1 to 2).

As a vanadate to be blended into the treatment solution, there can be mentioned lithium vanadate, sodium vanadate, potassium vanadate, magnesium vanadate, calcium vanadate, ammonium vanadate, etc.

The vanadium oxide to be blended into the treatment solution is a compound expressed by a general formula $VO_x$ (where x is in a range of from 1 to 2.5).

As a tungstate to be blended into the treatment solution, there can be mentioned lithium tungstate, sodium tungstate, potassium tungstate, magnesium tungstate, calcium tungstate, ammonium tungstate, etc.

The tungsten oxide to be blended into the treatment solution is a compound expressed by a general formula $WO_x$ (where x is in a range of from 2 to 3).

At least one selected from the group consisting of a molybdic acid or a salt thereof, a molybdenum oxide, a molybdophosphoric acid or a salt thereof, a zirconic acid or a salt thereof, a zirconium oxide, a vanadic acid or a salt thereof, a vanadium oxide, a tungstic acid or a salt thereof, and a tungsten oxide, is preferably blended in such a manner that the metallic ion generated therefrom in the form of a complex ion or an oxide ion is present in the treatment solution at a concentration of from 0.01 mol/L to 1.0 mol/L, but from the viewpoint of obtaining a chemical conversion film having sufficiently high corrosion resistance at low cost, it is more preferably blended in such a manner that a concentration in a range of from 0.05 mol/L to 0.3 mol/L is obtained.

The treatment solution may further contain an inorganic acid or a salt thereof (e.g., a sodium salt, a potassium salt, a calcium salt, etc.). For instance, phosphoric acid or a salt thereof, or a phosphorous acid or a salt thereof, may be added as the inorganic acid or the salt thereof to a treatment solution. A chemical conversion film that contains phosphorus together with (a) a metal such as molybdenum, (b) a rare earth metal constituting the magnet, and (c) oxygen, as the constituent components thereof, formed by using the above resulting treatment solution can be further improved in corrosion resistance.

Phosphoric acid or a salt thereof, or a phosphorous acid or a salt thereof is preferably blended in the treatment solution as such that the concentration of the phosphate ions or the phosphate ions falls within a range of from 0.01 mol/L to 1.0 mol/L.

The treatment solution may further contain divalent ions of magnesium. By using a treatment solution containing divalent ions of magnesium, the chemical conversion film that is obtained as a result can be further improved in corrosion resistance. The divalent ions of magnesium are incorporated in the solution in the form of a magnesium oxide, a magnesium hydroxide, or a magnesium salt of an inorganic acid. As specific examples of magnesium salts of inorganic acids, there can be mentioned magnesium sulfate, magnesium nitrate, or magnesium carbonate.

The divalent ions of magnesium are preferably added into the treatment solution in such a manner that the concentration thereof in the treatment solution falls within a range of from 0.01 mol/L to 2.0 mol/L.

The mechanism how divalent ions of magnesium exhibit the effect above is yet to be clarified, however, the effect is particularly distinct in case magnesium sulfate is used.

The treatment solution may further contain trivalent ions of iron. By using a treatment solution containing trivalent ions of iron, the corrosion resistance of the resulting chemical conversion film can be further improved. Trivalent ions of iron may be blended into the treatment solution in the form of an iron oxide, iron hydroxide, or an iron salt of inorganic or organic acids. As a specific example of an iron salt of an inorganic acid, there can be mentioned ferric nitrate or the like. As a specific example of an iron salt of an organic acid, there can be mentioned ferric citrate or the like. The incorporation of the trivalent ions of iron into the treatment solution can be accomplished by blending divalent ions of iron together with an oxidizing agent to thereby form the trivalent ions of iron in the treatment solution. In such a case, the divalent ions of iron may be added in the form of iron (II) sulfate. As the oxidizing agent, there can be added a substance as described hereinafter. Furthermore, the incorporation of the trivalent ions of iron into the treatment solution may be achieved by adding a solution obtained by dissolving an iron powder in an inorganic acid such as sulfuric acid, into the treatment solution together with, if necessary, an oxidizing agent, such that trivalent ions of iron may be formed in the treatment solution.

The trivalent ions of iron are preferably added into the treatment solution in such a manner that the concentration thereof in the treatment solution falls within a range of from 0.0001 mol/L or higher. However, in case phosphate ions or phosphite ions are present in the treatment solution, the upper limit of the concentration of the trivalent ions of ion is preferably set at 0.01 mol/L. If the trivalent ions of iron should be present in excess, there is fear of producing precipitates of phosphates or phosphites of trivalent ions of iron.

The treatment solution may further contain an oxidizing agent. For instance, by using a treatment solution containing nitric acid or a salt thereof, or nitrous acid or a salt thereof as the oxidizing agent, the generation of gaseous hydrogen can be suppressed during the process of forming the film to thereby obtain a dense chemical conversion film.

Nitric acid or a salt thereof, or nitrous acid or a salt thereof which functions as an oxidizing agent, is preferably blended into the treatment solution in such a manner that the concentration thereof in the treatment solution falls within a range of from 0.01 mol/L to 0.3 mol/L. As nitrates and nitrites, there can be used nitric acid or nitrous acid salts of sodium, potassium, calcium, etc.

The pH of the treatment solution is preferably adjusted in a range of from 1 to 7, however, from the viewpoint of suppressing the corrosion of the magnet during the formation of the film while assuring high reactivity of the treatment solution on the surface of the magnet, the pH is more preferably adjusted in a range of from 2.5 to 3.5.

Furthermore, as described above, the treatment solution may contain an inorganic acid or a salt thereof, and the pH value of the treatment solution can be adjusted to the desired value by controlling the quantity of their addition. If necessary, an inorganic acid such as hydrochloric acid, sulfuric acid, nitric acid, etc., or an organic acid such as malic acid, malonic acid, citric acid, succinic acid, etc., can be used as a pH controller.

Thus, a chemical conversion film is formed by treating the surface of the magnet using the treatment solution thus prepared. More specifically, there can be mentioned a method of applying the resulting treatment solution to the surface of the magnet. Employable applying methods include dipping, spraying, spin-coating, etc., but preferably employed is dipping, because the surface of the magnet can be efficiently reacted with the treatment solution, and because high productivity can be thereby achieved. During the treatment, the temperature of the treatment solution is preferably maintained in a temperature range of from 0° C. to 90° C., more preferably, in a range of from 30° C. to 60° C., and the most preferably, in a range of from 40° C. to 50° C. If the temperature of the treatment solution is held too low, it becomes difficult to form a chemical conversion film having a sufficiently high corrosion resistance. If the temperature of the treatment solution is set too high, the treatment solution may undergo degradation in a short period of time or the reaction may proceed in excess on the surface of the magnet, and it results in making it difficult to form a uniform chemical conversion film. The duration of treatment is preferably set in a range of from 1 minute to 90 minutes, but from the viewpoint of forming a chemical conversion film having a sufficiently high corrosion resistance while yet achieving superior productivity, it is more preferred to perform the treatment in 5 minutes to 30 minutes. It should be noted, however, that no deposition step for forming a deposition layer as described in Japanese Patent Laid-Open No. 2000-199074 is incorporated in the process of the present invention. If a process as described in Japanese Patent Laid-Open No. 2000-199074 should be performed, the deposition layer that is formed as a result becomes different from the chemical conversion film according to the present invention as that described in paragraph number 0015 of the aforementioned published Japanese patent application.

After treating the surface of the magnet, the residual treatment solution adhered to the surface thereof is preferably removed by rinsing it off. Since the treatment solution is acidic, there is fear of causing corrosion of the magnet by the residual treatment solution. After rinsing the surface of the magnet, drying treatment is preferably performed to dry the surface of the magnet. The drying method is not particularly limited, and drying using hot air or in drying furnace, as well as natural drying, may be employed.

As the rare earth metal-based permanent magnets applicable to the present invention, there can be mentioned, for instance, known rare earth metal-based permanent magnets such as a R—Co based permanent magnet, a R—Fe—B based permanent magnet, a R—Fe—N based permanent magnet, etc. Among them, particularly preferred are the R—Fe—B based permanent magnets, because, as described above, they not only possess superior magnetic properties, but also exhibit superiority in mass productivity and economical advantages, as well as in adhesiveness with the film. As the rare earth metal-based permanent magnets, preferred are those containing at least one type selected from the group consisting of Nd, Pr, Dy, Ho, Tb, and Sm, as the rare earth element (R), or containing at least one type selected from the group consisting of La, Ce, Gd, Er, Eu, Tm, Yb, Lu, and Y.

In general, one type of the aforementioned rare earth metals is sufficient for use as R, but in practice, from the viewpoint of ease in availability and the like, it is possible to use a mixture of two or more types (misch metal or didymium).

Furthermore, by adding at least one type selected from the group consisting of Al, Ti, V, Cr, Mn, Bi, Nb, Ta, Mo, W, Sb, Ge, Sn, Zr, Ni, Si, Zn, Hf, and Ga, it is possible to improve the coercive force, the rectangularity of a demagnetizing curve, and productivity, or to reduce cost. Furthermore, by substituting a part of Fe with Co, the temperature characteristics of the resulting magnet can be improved without impairing the magnetic properties.

The rare earth metal-based permanent magnet according to the present invention may include, in addition to a sintered magnet, magnetic powder for use in producing a bonded magnet.

The chemical conversion film containing, at least as the constituent components thereof, (a) at least one of the metals selected from molybdenum, zirconium, vanadium, and tungsten; (b) a rare earth metal constituting the magnet; and (c) oxygen; which is formed on the surface of a rare earth metal-based permanent magnet by using above methods, contains a composite metal oxide provided on the surface of the R-rich phase having a lower oxidation-reduction potential through a preferential reaction of the metallic ions that are present in the form of complex ions or oxide ions, such as of molybdenum, contained in the treatment solution, with the rare earth metals that elute from the magnet. Thus formed composite metal oxide reduces the difference in corrosion potential as to realize a uniform surface potential, and effectively suppresses the corrosion based on potential difference. Accordingly, the chemical conversion film thus formed is dense, yields strong adhesiveness to the magnet, and exhibits sufficiently high corrosion resistance even if it is provided as a thin film so long as it is provided at a film thickness of 0.001 $\mu$m or thicker. The characteristics above is particularly distinct in case of a chemical conversion film containing molybdenum. The upper limit for the film thickness of the chemical conversion film produced in accordance with the present invention is not limited, but from the requirements on dimensional precision and on compactness of the magnet, it is preferably 1 $\mu$m or less, more preferably, 0.5 $\mu$m or less, and the most preferably, 0.1 $\mu$m or less.

In case the present invention is applied to a R—Fe—B based permanent magnet or a R—Fe—N based permanent magnet, the chemical conversion film formed contains iron as the constituent component. That is, iron constituting the magnet may be incorporated directly into the film, or may be eluted into the treatment solution and then taken into the film. The iron eluted into the treatment solution becomes a trivalent ion of iron, and contributes to the improvement of corrosion resistance of the chemical conversion film thus formed in the manner above.

Furthermore, another film may be laminated on the chemical conversion film according to the present invention. By employing such a constitution, further enforcement of the properties can be achieved, complementary properties may be added, or additional functionality may be imparted to the chemical conversion film.

EXAMPLE 1

A Nd—Fe—B based permanent magnet (sintered magnet) of a composition of 17 wt % Nd-1wt % Pr-75 wt % Fe-7 wt % B, with a size 10 mm in length, 50 mm in width, and 5 mm in height, was degreased with an organic solvent, lightly pickled with an aqueous phosphoric acid solution, and was subjected to the experiments described below.

Treatment solutions of desired composition were prepared by uniformly dissolving each of the components given in Table 1 into water. The treatment solutions were each held at a temperature of 40° C., in which the magnet was immersed for 20 minutes to form a chemical conversion film on the surface thereof. The magnet was drawn out from the treatment solution, and the surface thereof was rinsed and dried at 150° C. for two minutes by using a dryer.

On performing a measurement by an XPS (X-ray Photoelectron Spectroscopy) on the chemical conversion film formed by using the treatment solution of Example 1-4 to 1-6, the film was found to contain molybdenum, neodymium, iron, oxygen, and phosphorus. Furthermore, the film thickness of the thus obtained chemical conversion film was found to be 0.05 $\mu$m. The XPS measurement was performed by using ESCA-850 (manufactured by Shimadzu Corp.), under a vacuum degree of $10^{-6}$ Pa by applying an accelerating voltage of 8.0 kV and a current of 30 mA. Furthermore, the film thickness of the chemical conversion film was measured by performing Ar ion etching (beam scanning) for analyzing in the depth direction under an accelerating voltage of 2.0 kV and a current of 20 mA, while rotating the sample.

The chemical conversion film formed by using the treatment solution of Example 1-1 to 1-6 was subjected to observation using an EPMA (Electron Probe Micro Analyzer). As a result, the presence of molybdenum on the Nd-rich phase was strongly indicated, and molybdenum was also observed on the $Nd_2Fe_{14}B$ phase. The EPMA used herein was EPM-810 (manufactured by Shimadzu Corp.).

The magnets each having formed thereon a chemical conversion film by using each of the treatment solutions given in Examples 1-1 to 1-6 were subjected to corrosion resistance test by allowing them to stand under high-temperature and high-humidity conditions of a temperature of 80° C. and a relative humidity of 90%. The surface of the magnets was visually inspected to obtain time for generating rust, and this time was used as a standard for passing the corrosion resistance test. The results are given in Table 2. As a result, a chemical conversion film exhibiting excellent corrosion resistance is formed by using a treatment solution of Example 1-4 to 1-6, in which the pH value was adjusted by using phosphoric acid.

TABLE 1

| | Sodium molybdate | Phosphoric acid | Oxidizing agent | pH Controller | pH |
|---|---|---|---|---|---|
| Example 1-1 | 0.1 M | None | None | None | 6.5 |
| Example 1-2 | " | " | " | Citric acid | 3.2 |
| Example 1-3 | " | " | 0.1 M Sodium Nitrate | " | " |
| Example 1-4 | " | 0.18 M[1)] | None | None | " |
| Example 1-5 | " | " | 0.1 M Sodium Nitrite | " | " |
| Example 1-6 | " | " | 0.1 M Sodium Nitrate | " | " |

[1)]Concentration of phosphate ions
* M represents mol/L

TABLE 2

| | Corrosion resistance test result (hours) |
|---|---|
| Example 1-1 | 10 |
| Example 1-2 | 15 |
| Example 1-3 | 15 |
| Example 1-4 | 75 |
| Example 1-5 | 75 |
| Example 1-6 | 75 |

EXAMPLE 2

A Nd—Fe—B based permanent magnet (sintered magnet) of a composition of 17 wt % Nd-1 wt % Pr-75 wt % Fe-7 wt % B, with a size 10 mm in length, 50 mm in width, and 5 mm in height, was degreased with an organic solvent, lightly pickled with an aqueous phosphoric acid solution, and was subjected to the experiments described below.

The components given in Table 3 were each uniformly dissolved in water to obtain treatment solutions of desired composition. The resulting treatment solutions were each held at a temperature of 40° C., in which the magnet was immersed for 20 minutes to form a chemical conversion film on the surface thereof. The magnet was drawn out from the treatment solution, and the surface thereof was rinsed and dried at 150° C. for two minutes by using a dryer.

The magnets each having formed thereon a chemical conversion film in the manner above were subjected to a corrosion resistance test similar to that described in Example 1. The results are given in Table 4. As a result, it has been found that a chemical conversion film having excellent corrosion resistance is formed in case the pH value of the treatment solution is adjusted in a range of from 2.5 to 3.5.

TABLE 3

| | Sodium molybdate | Trisodium phosphate | Oxidizing agent | pH[2)] |
|---|---|---|---|---|
| Example 2-1 | 0.1 M | 0.02 M[1)] | 0.1 M sodium nitrate | 1.8 |
| Example 2-2 | " | " | " | 2.5 |
| Example 2-3 | " | " | " | 3.0 |
| Example 2-4 | " | " | " | 3.5 |
| Example 2-5 | " | " | " | 4.0 |

[1)]Concentration of phosphate ions
[2)]Adjusted by using nitric acid
* M represents mol/L

TABLE 4

| | Corrosion resistance test result (hours) |
|---|---|
| Example 2-1 | 30 |
| Example 2-2 | 80 |
| Example 2-3 | 80 |
| Example 2-4 | 80 |
| Example 2-5 | 40 |

TABLE 5

| | Corrosion resistance test result (hours) |
|---|---|
| Example 3-1 | 30 |
| Example 3-2 | 120 |
| Example 3-3 | 120 |
| Example 3-4 | 120 |
| Example 3-5 | 40 |

EXAMPLE 3

A Nd—Fe—B based permanent magnet (sintered magnet) of a composition of 26 wt % Nd-72 wt % Fe-1 wt % B-1 wt % Co, with a size 10 mm in length, 50 mm in width, and 5 mm in height, was degreased with an organic solvent, lightly pickled with an aqueous phosphoric acid solution, and was subjected to the experiments described below.

Treatment solutions similar to those described in Example 2 were prepared. The treatment solutions were each held at a temperature of 40° C., in which the magnet was immersed for 20 minutes to form a chemical conversion film on the surface thereof. The magnet was drawn out from the treatment solution, and the surface thereof was rinsed and dried at 150° C. for two minutes by using a dryer.

The magnets each having formed thereon a chemical conversion film in the manner above were subjected to a corrosion resistance test similar to that described in Example 1. The results are given in Table 5. As a result, it has been found that a chemical conversion film having excellent corrosion resistance is formed in case the pH value of the treatment solution is adjusted in a range of from 2.5 to 3.5.

EXAMPLE 4

A Nd—Fe—B based permanent magnet (sintered magnet) of a composition of 26 wt % Nd-72 wt % Fe-1 wt % B-1 wt % Co, with a size 10 mm in length, 50 mm in width, and 5 mm in height, was degreased with an organic solvent, lightly pickled with an aqueous phosphoric acid solution, and was subjected to the experiments described below.

The components given in Table 6 were each uniformly dissolved in water to obtain treatment solutions of desired composition. The resulting treatment solutions were each held at a temperature of 40° C., in which the magnet was immersed for 20 minutes to form a chemical conversion film on the surface thereof. The magnet was drawn out from the treatment solution, and the surface thereof was rinsed and dried at 150° C. for two minutes by using a dryer.

The magnets each having formed thereon a chemical conversion film in the manner above were subjected to a corrosion resistance test similar to that described in Example 1. The results are given in Table 7. As a result, it has been found that a chemical conversion film having excellent corrosion resistance is formed in case a treatment solution having added therein divalent ions of magnesium and whose pH value is adjusted in a range of from 2.5 to 3.5 is used.

TABLE 6

| | Sodium molybdate | Trisodium phosphate | Oxidizing agent | Additive | pH[2)] |
|---|---|---|---|---|---|
| Example 4-1 | 0.1 M | 0.02 M[1)] | 0.1 M sodium nitrate | None | 3.0 |
| Example 4-2 | " | " | " | 0.05 M magnesium nitrate | " |
| Example 4-3 | " | " | " | 0.1 M magnesium sulfate | " |
| Example 4-4 | " | " | " | 0.3 M magnesium sulfate | " |
| Example 4-5 | " | " | " | 0.5 M magnesium sulfate | " |
| Example 4-6 | " | " | " | 1.0 M magnesium sulfate | " |
| Example 4-7 | " | " | " | 0.3 M magnesium sulfate | 1.8 |
| Example 4-8 | " | " | " | " | 2.5 |
| Example 4-9 | " | " | " | " | 3.5 |
| Example 4-10 | " | " | " | " | 4.0 |

[1)]Concentration of phosphate ions
[2)]Adjusted by using nitric acid
* M represents mol/L

TABLE 7

| | Corrosion resistance test result (hours) |
|---|---|
| Example 4-1 | 80 |
| Example 4-2 | 100 |
| Example 4-3 | 100 |
| Example 4-4 | 200 |
| Example 4-5 | 200 |
| Example 4-6 | 200 |
| Example 4-7 | 30 |
| Example 4-8 | 200 |
| Example 4-9 | 200 |
| Example 4-10 | 40 |

EXAMPLE 5

A Nd—Fe—B based permanent magnet (sintered magnet) of a composition of 26 wt % Nd-72 wt % Fe-1 wt % B-1 wt % Co, with a size 10 mm in length, 50 mm in width, and 5 mm in height, was degreased with an organic solvent, lightly pickled with an aqueous phosphoric acid solution, and was subjected to the experiments described below.

The components given in Table 8 were each uniformly dissolved in water to obtain treatment solutions of desired composition. The resulting treatment solutions were each held at a temperature of 40° C., in which the magnet was immersed for 20 minutes to form a chemical conversion film on the surface thereof. The magnet was drawn out from the treatment solution, and the surface thereof was rinsed and dried at 150° C. for two minutes by using a dryer.

The magnets each having formed thereon a chemical conversion film in the manner above were subjected to a corrosion resistance test similar to that described in Example 1. The results are given in Table 9. As a result, it has been found that a chemical conversion film having excellent corrosion resistance is formed in case a treatment solution having added therein divalent ions of magnesium and further added therein trivalent ions of iron, is used.

TABLE 8

| | Sodium molybdate | Trisodium phosphate | Oxidizing agent | Additive1 | Additive2 | pH[2)] |
|---|---|---|---|---|---|---|
| Example 5-1 | 0.1 M | 0.02 M[1)] | 0.1 M sodium nitrate | None | None | 3.0 |
| Example 5-2 | " | " | " | 0.3 M magnesium sulfate | " | " |
| Example 5-3 | " | " | " | " | 0.001 M ferric nitrate | " |

[1)]Concentration of phosphate ions
[2)]Adjusted by using nitric acid
* M represents mol/L

TABLE 9

| | Corrosion resistance test result (hours) |
|---|---|
| Example 5-1 | 120 |
| Example 5-2 | 200 |
| Example 5-3 | 230 |

What is claimed is:

1. A method for producing a permanent magnet comprising a rare earth metal-based permanent magnet having provided directly on the surface thereof a chemical conversion film containing, at least as the constituent components thereof, (a) at least one metal selected from the group consisting of molybdenum, zirconium, vanadium, and tungsten; (b) a rare earth metal from the rare earth metal-based permanent magnet; (c) oxygen; and (d) phosphorous, said method comprising:

directly treating the surface of a rare earth metal-based permanent magnet with a treatment solution containing at least one selected from the group consisting of a molybdic acid or a salt thereof, a molybdenum oxide, a molybdophosphoric acid or a salt thereof, a zirconic acid or a salt thereof, a zirconium oxide, a vanadic acid or a salt thereof, a vanadium oxide, a tungstic acid or a salt thereof, a tungsten oxide, wherein said treatment solution further contains a phosphoric acid or a salt thereof and/or a phosphorous acid or a salt thereof, wherein the treating causes a reaction between metallic ions in the treatment solution and the rare earth metals that elute from the magnet.

2. A production method as claimed in claim 1, wherein said treatment solution further contains a divalent ion of magnesium.

3. A method for producing a permanent magnet comprising a rare earth metal-based permanent magnet having provided on the surface thereof a chemical conversion film containing, at least as the constituent components thereof, (a) at least one metal selected from the group consisting of molybdenum, zirconium, vanadium, and tungsten; (b) a rare earth metal from the rare earth metal-based permanent magnet; and (c) oxygen; said method comprising:

treating the surface of a rare earth metal-based permanent magnet with a treatment solution containing at least one selected from the group consisting of a molybdic acid or a salt thereof, a molybdenum oxide, a molybdophosphoric acid or a salt thereof, a zirconic acid or a salt thereof, a zirconium oxide, a vanadic acid or a salt thereof, a vanadium oxide, a tungstic acid or a salt thereof, and a tungsten oxide wherein said treatment solution further contains a trivalent ion of iron.

4. A production method as claimed in claim 1, wherein said treatment solution further contains an oxidizing agent.

5. A production method as claimed in claim 4, wherein said oxidizing agent is nitric acid or a salt thereof and/or a nitrous acid or a salt thereof.

* * * * *